US012349800B2

(12) United States Patent
Tsai

(10) Patent No.: US 12,349,800 B2
(45) Date of Patent: Jul. 8, 2025

(54) CUSHION AIRBAG PAD AND MANUFACTURE METHOD THEREOF

(71) Applicant: Dongguan Jiashuan Industrial Co., Ltd., Guangdong (CN)

(72) Inventor: Pei-Lin Tsai, Guangdong (CN)

(73) Assignee: Dongguan Jiashuan Industrial Co., Ltd., Guangdong (CN)

( * ) Notice: Subject to any disclaimer, the term of this patent is extended or adjusted under 35 U.S.C. 154(b) by 0 days.

(21) Appl. No.: 19/031,813

(22) Filed: Jan. 18, 2025

(65) Prior Publication Data

US 2025/0160530 A1 May 22, 2025

Related U.S. Application Data

(63) Continuation-in-part of application No. 18/687,908, filed as application No. PCT/CN2022/083132 on Mar. 25, 2022.

(30) Foreign Application Priority Data

Nov. 11, 2021 (CN) ..... 202111331587.0
Nov. 11, 2021 (CN) ..... 202122753793.2

(51) Int. Cl.
*A47C 27/00* (2006.01)
*A47C 27/08* (2006.01)
*A47C 27/10* (2006.01)

(52) U.S. Cl.
CPC ..... *A47C 27/00* (2013.01); *A47C 27/081* (2013.01); *A47C 27/10* (2013.01); *A47C 27/08* (2013.01)

(58) Field of Classification Search
CPC ..... A47C 27/00; A47C 27/08; A47C 27/081; A47C 27/10
USPC ..... 5/655.3, 654, 644, 706, 710
See application file for complete search history.

(56) References Cited

U.S. PATENT DOCUMENTS 2,068,134 A * 1/1937 Houghton ..... A47C 27/081 5/708
3,068,494 A * 12/1962 Pinkwater ..... A47C 27/081 5/708
3,133,696 A * 5/1964 Mirando ..... A47C 27/081 92/92
5,144,708 A * 9/1992 Pekar ..... A47C 27/084 137/846

(Continued)

FOREIGN PATENT DOCUMENTS

GB 2269743 A * 2/1994 ..... A47C 27/081

*Primary Examiner* — Robert G Santos
(74) *Attorney, Agent, or Firm* — ScienBiziP, P.C.

(57) ABSTRACT

The present disclosure provides a cushion airbag pad capable of reliably one way air-inlet into the interior of the airbag, and the manufacture method thereof. The cushion airbag pad, comprising a cushion body comprising a main body, a plurality of airbags and a plurality of air passages, one of the plurality of airbags is an intake airbag; and a one-way air inlet member being a thin sheet structure and mounted in the intake airbag, wherein a first embossed portion is formed on the main body and is in contact with at least a part of the one-way air inlet member in an overlapping manner, and a hardness of a portion of the main body corresponding to the first embossed portion is greater than a hardness of a portion of the main body corresponding to the one-way air inlet member, and does not overlap with first embossed portion.

19 Claims, 10 Drawing Sheets

(56) References Cited

U.S. PATENT DOCUMENTS

| | | | | | |
|---|---|---|---|---|---|
| 5,564,143 | A * | 10/1996 | Pekar | F16K 15/147 | 137/846 |
| 5,632,055 | A * | 5/1997 | Graf | A47C 27/088 | 5/709 |
| 6,934,989 | B2 * | 8/2005 | Ledvina | A47G 9/1027 | 5/644 |
| 7,146,665 | B1 * | 12/2006 | Moorin | A47C 7/383 | 5/639 |
| 2004/0064892 | A1 * | 4/2004 | Ledvina | A47G 9/1027 | 5/644 |

* cited by examiner

CUSHION AIRBAG PAD AND MANUFACTURE METHOD THEREOF

CROSS REFERENCE TO RELATED DISCLOSURES

This application is a continuation-in-part of U.S. patent application Ser. No. 18/687,908, filed Feb. 29, 2024, which is incorporated herein by reference in its entirety.

TECHNICAL FIELD

The present disclosure relates to the field of household appliances, and in particular, to a cushion airbag pad and the manufacture method thereof.

BACKGROUND

As a product for providing pressure cushioning, a cushion airbag pad is widely applied to various articles, for example, cushioning pads such as a bag shoulder strap, a seat cushion, a backrest cushion, a mattress, and a shoe cushion, which can cushion the pressure of a user contact part.

However, in the existing airbag pad, after air filled in the airbags of the airbag pad, part of the air slowly leaks outside through the air inlet, and therefore, the overall airbag pad appears a phenomenon of slow air leakage, resulting in the air in the airbag being insufficient after using the cushion for a period of time, but also the cushion needs to be inflated again, thereby causing inconvenience in use.

Therefore, there is a need for a cushion airbag pad capable of reliably one way air-inlet into the interior of the airbag, and the manufacture method thereof.

DETAILED DESCRIPTION

To make the foregoing objectives, features, and advantages of the present disclosure clearer, the following clearly and completely describes the technical solutions in the embodiments of the present disclosure with reference to the drawings in the embodiments of the present disclosure. It should be noted that the embodiments and features in the embodiments of the present disclosure can be combined with each other without conflict.

Figure 1:
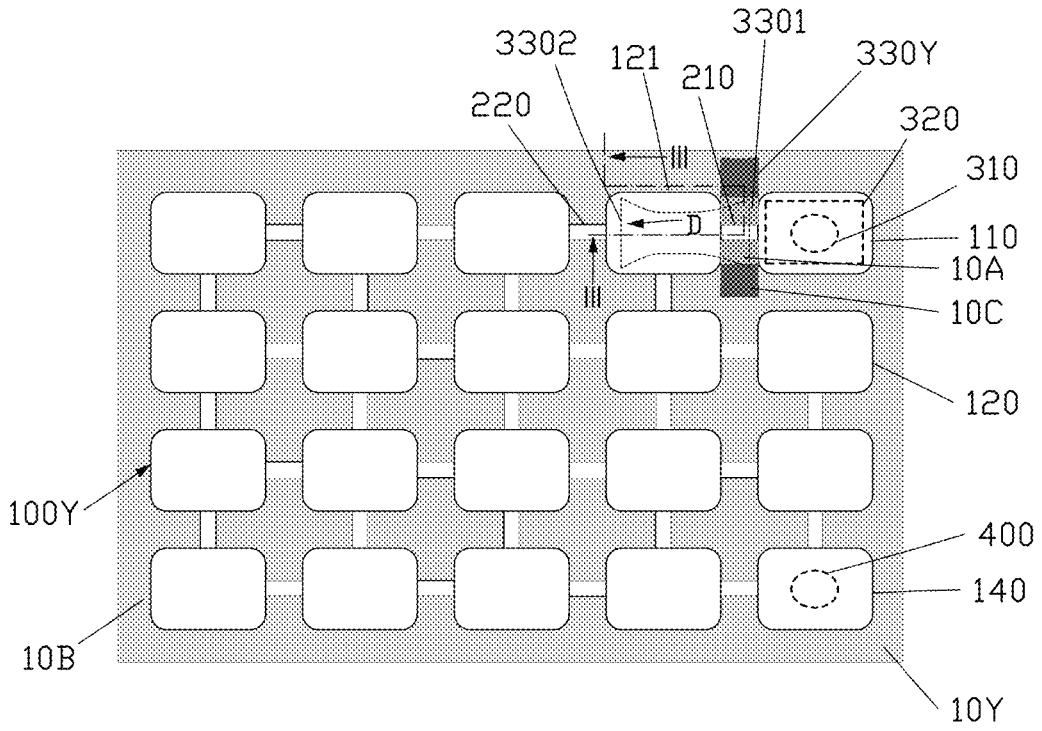
FIG. 1 is a schematic top view showing a manufacturing example of a cushion airbag pad of the present disclosure.
Figure 2:
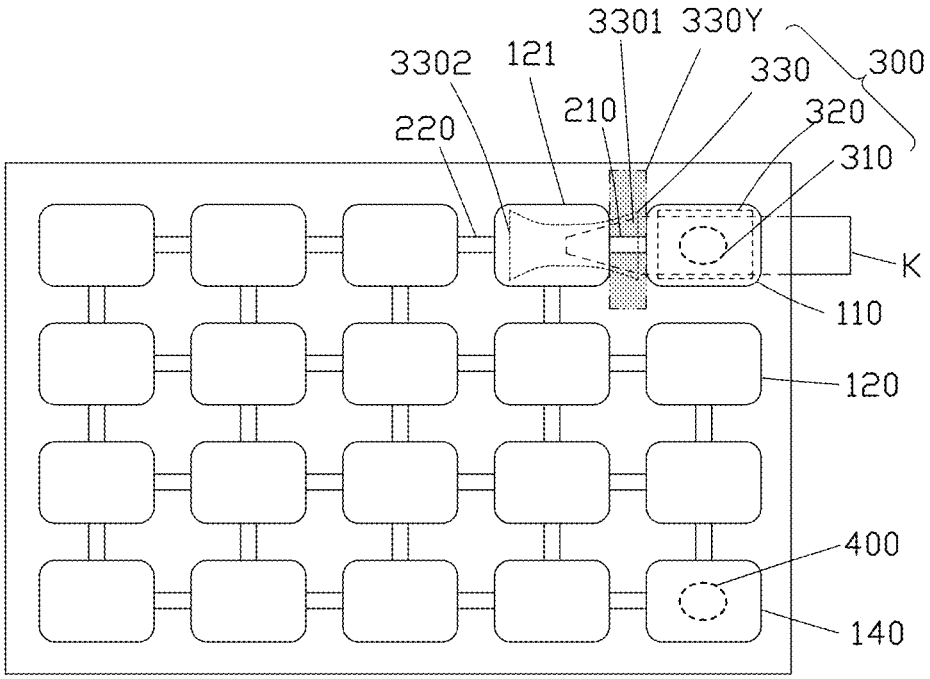
FIG. 2 is a schematic plan view showing an example of a cushion airbag pad of the present disclosure.

FIG. 1 shows a cushion airbag pad 1000 of the present embodiment, which comprises a cushion body 10 and an inflation and deflation component (not shown) provided on the cushion body 10.

The cushion body 10 includes a main body 1, as well as a plurality of air bags 100 and air passages 200 formed by being bulged from the main body 1. The plurality of air bags 100 and the plurality of air passages 200 bulge towards a surface of at least one side of the cushion body 10, and two adjacent air bags 100 are in communication via the air passages 200. Throughout the entirety of the main body 1, the cushion body 10 is not bulged and encompasses the outer circumference of the plurality of air bags 100 and air passages 200.

An inflation and deflation component is provided in the cushion body 10 for controlling inflation and deflation of the plurality of air bags 100. The inflation and deflation unit includes an inflation unit 300 and a deflation unit 400. The inflation unit 300 is used for controlling inflation of the plurality of air bags 100, so that the air unidirectionally enters the interior of the plurality of air bags 100, and the air is prevented from being discharged to the outside. The inflation unit 300 at least comprises a one-way air inlet member 330, and the one-way air inlet member 330 is a member capable of achieving one-way air inlet and is arranged inside the airbag 100.

Figure 3:
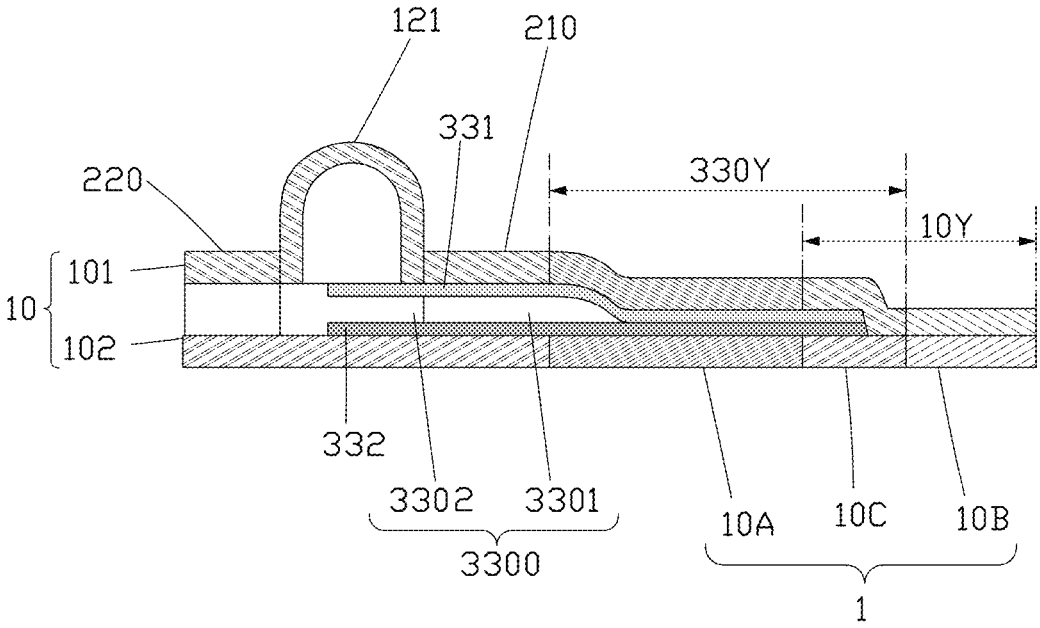
FIG. 3 is a schematic cross-sectional view taken along line III-III of FIG. 1.

Specifically, as shown in FIGS. 1 and 3, the cushion body 10 is a unitary structure formed by stacking a first cushion layer 101 and a second cushion layer 102. The first cushion layer 101 and the second cushion layer 102 contain flexible materials that can be thermally fused, for example, Polyether TPU, Polyester TPU (Thermoplastic polyurethanes), PVC, EVA or other flexible materials that can be thermally fused. The first cushion layer 101 and the second cushion layer 102 overlapped each other are pressed together by means of such as welding, so as to form an integrated cushion body 10. Apart of the second cushion layer 102 and a part of the first cushion layer 101 are pressed together to form the main body 1, which is a region where the second cushion layer 102 and the first cushion layer 101 are closely adhered but do not bulge when being inflated. In addition, the other part of the second cushion layer 102 and the other part of the first cushion layer 101 are not adhered together to form a plurality of air bags 100 and a plurality of air passages 200 which are arranged in a predetermined shape on the first cushion layer 101 and bulged in a direction away from the second cushion layer 102. The inner air of the plurality of airbags 100 and the plurality of air passages 200 is sealed from the outside of the cushion 10.

In addition, the plurality of airbags 100 and the plurality of air passages 200 may be arranged in a convex shape on one or both of the first cushion layer 101 and the second cushion layer 102. The plurality of airbags 100 and the plurality of air passages 200 which are arranged in a protruding manner are formed by laminating the first cushion layer 101 and the second cushion layer 102 after pre-forming a convex shape on the two cushion layers. Therefore, after forming the cushion body 10, the plurality of airbags 100 and the plurality of air passages 200 are in a convex shape even in an uninflated state and easy to sink when being pressed; and the airbags 100 are full after being inflated, and are not easy to sink when being pressed. In addition, the first cushion layer 101 and the second cushion layer 102 do not have to be formed in a convex shape in advance, and in such a cushion airbag pad 1000, the cushion airbag cushion is flat when not inflated, and bulged upon inflation to form a double-sided convex shape.

The main body 1 includes a first laminated portion 10A, a second laminated portion 10B, and a first embossed portion 10C. A part of the main body 1 is laminated once at the first laminated portion 10A, and a part of the main body 1 is laminated once at the second laminated portion 10B in a process different from the bonding process of forming the first laminated portion 10A. The first laminated portion 10A is in contact with at least a part of an inlet portion 3301 of the one-way air inlet member 330 in an overlapping manner in a plane view, the first embossed portion 10C is also in contact with at least a part of the inlet portion 3301 of the one-way air inlet member 330 in an overlapping manner. At the first embossed portion 10C, a part of the main body 1 is laminated twice, and the first embossed portion 10C is connected to both the first laminated portion 10A and the second laminated portion 10B so as to be interposed between the first laminated portion 10A and the second laminated portion 10B. The air-intake airbag 121 is jointly surrounded by the first laminated portion 10A, the second laminated portion 10B, and the first embossed portion 10C. In the first embossed section 10C, the outer surface of at least one cushion layer 101, 102 of the cushion body 10 exhibits embossing.

The embossed presented by the first embossed portion 10C may be embossed formed by melt-laminating and extrusion of a heat-fusible flexible material contained in the cushion body 10 during the laminating, for example, a boundary between the first embossed portion 10C and the first laminated portion 10A, a boundary between the first embossed portion 10C and the second laminated portion 10B may be formed into a step shape, wrinkles or the like. Such step shapes and wrinkles may be formed due to factors such as mold inconsistency and misalignment during bonding. In addition, the first cushion layer 101 and the second cushion layer 102 may be a composite structure with an inner layer of a flexible material that can be thermally fused and an outer layer of a textile material. Therefore, the hardness of the first embossed portion 10C may be higher than that of the first laminated portion 10A and the second laminated portion 10B which are laminated once, and the surface of the first embossed portion 10C may be smoother than the surface of the first laminated portion 10A and the second laminated portion 10B. It is assumed that, after the secondary bonding, more heat-fusible flexible material is immersed in the textile material than the first laminated portion 10A and the second laminated portion 10B, which increases density of the cushion body 10 at the first embossed portion 10C and makes the cushion body 10 harder. In addition, because a portion of the heat-fusible flexible material in the inner layer is immersed into the outer surface of the textile material (i. e. the outer surface of the cushion body 10), the gap between the textile materials is filled, so that the surface is smoother.

The plurality of air bags 100 comprise an inflation airbag 110 used for inflating the cushion airbag pad 1000 as a starting point of the flow of the internal air and a deflation airbag 140 used for deflating the cushion airbag pad 1000 as a finishing point of the flow of the internal air, and the inflation airbag 110 and the deflation airbag 140 are in communication with each other via the other air bags 120 and a plurality of air passages 200. The plurality of airbags 100 are inflated by operating the inflation airbag 110, and the plurality of airbags 100 are deflated by operating the deflation airbag 140. In addition, the other airbag 120 includes the intake airbag 121 as a starting point for the inner air to flow there through, and the plurality of air passages 200 include an intake air passage 210 and a plurality of ventilation passages 220. The intake air passage 210 serves as a starting point through which the air of all the air passages 200 flows, and a plurality of ventilation passages 220 are connected at a downstream side of the intake airbag. The inflation airbag 110 at the upstream side communicates with the intake airbag 121 on the downstream side via the intake air passage 210, so that the inflation airbag 110 can communicate with the other airbag 120. A one-way air inlet member 330 is mounted in the intake airbag 121. Through the one-way air inlet member 330, the air charged into the inflation airbag 110 can be unidirectionally introduced into the intake airbag 121. Furthermore, the plurality of the ventilation passages 220 respectively connected between the other air bags 120 which are adjacent and between the other air bags 120 and the deflation air bag 140, so that the air introduced unidirectionally into the intake air bag 121 can smoothly circulate in all the air bags 100.

As shown in FIG. 1, the first laminated portion 10A is disposed between the inflation airbag 110 and the intake airbag 121, and has at least a part connected to the intake airbag 121, and this part is divided into two parts by the intake air passage 210. The first embossed portions 10C are connected to both sides of the first laminated portion 10A away from the intake air passage 210. The second laminated portion 10B is formed at a region of the main body 1 excluding the first laminated portion 10A and the first embossed portion 10C, and surrounds the first laminated portion 10A, all of the airbags 100, and all of the outer circumferences of the air passages 200. Thus, the intake airbag 121 is connected and surrounded by the first laminated portion 10A, the second laminated portion 10B, and the first embossed portion 10C, or the intake airbag 121 is connected and surrounded by the first laminated portion 10A and the second laminated portion 10B.

In this embodiment, as shown in FIGS. 1 and 3, the one-way air inlet member 330 of the inflation unit 300 is mounted in the intake airbag 121 and is sandwiched between the first cushion layer 101 and the second cushion layer 102 of the cushion airbag pad 1000. The one-way air inlet member 330 allows air to enter the interior of the plurality of airbags 100 unidirectionally. The one-way air inlet member 330 has a film structure in which a one-way intake passage 3300 communicate with the inflation airbag 110 and the intake airbag 121 in one-way is formed. The one-way intake passage 3300 extends along the intake direction D (i. e. the direction from the inflation airbag 110 to the intake airbag 121), and the inlet portion 3301 is in communication with the outlet portion 3302 via the one-way intake passage 3300, such that the one-way intake passage 3300 can communicate the inflation airbag 110 with the intake airbag 121. The air enters the inlet portion 3301 of the one-way air inlet member 330 sequentially from the inflation airbag 110 and the intake air passage 210, enters the intake airbag 121 from the outlet part 3302 of the one-way air inlet member 330 after passing through the one-way intake passage 3300, and diffuses to each of the other airbags 120 via the ventilation passage 220. In a natural state, the one-way intake passages 3300 in the one-way air inlet member 330 is closed to prevent the air from flowing through, and the one-way air inlet member 330 can be expanded under an air pressure difference, thereby allowing the air to flow through the one-way intake passage 3300, so as to realize one-way air intake. The one-way air inlet member 330 is made of, for example, polyether TPU and polyester TPU (thermoplastic polyurethanes) or PVC, EVA or other plastic sheet materials.

Figure 5:
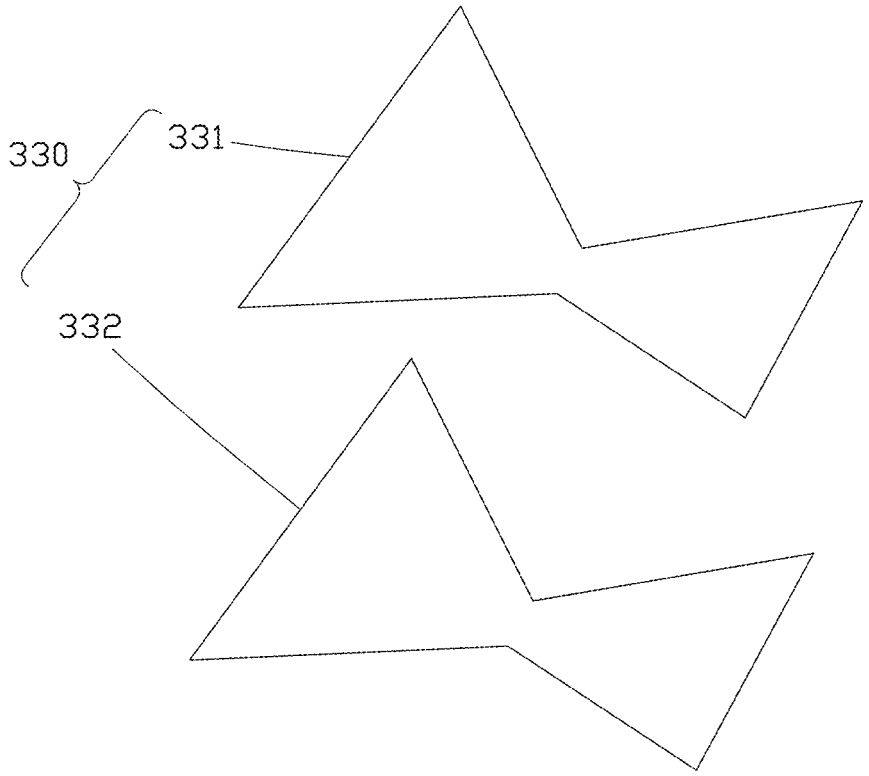
FIG. 5 is a schematic exploded perspective view showing a one-way air inlet member used in the cushion airbag pad of the present disclosure.

In the present embodiment, as shown in FIG. 5, the one-way air inlet member 330, for example, is an integrated structure in which two sheets 331, 332 are joined together. Two side edges of the first sheet 331 and the second sheet 332 are bonded together, for example, by means of welding, so that the two side end edges of the one-way air inlet member 330 are closed and the other two side edges are open. The first sheet 331 and the second sheet 332 are flexible and flat films (e. g., plastic sheets), such as polyether TPU and polyester TPU (thermoplastic polyurethanes) or PVC, EVA or other plastic sheet materials. The one-way intake passage 3300 is formed between the thin-film first sheet 331 and the second sheet 332 in the form of thin films. In particular, inner surfaces of the first sheet 331 and the second sheet 332 which are in contact with each other are smooth, so that the first sheet 331 and the second sheet 332 can be attracted to each other when they are in contact with each other, thereby achieving the effect of closing the one-way intake passages 3300. Also, under the action of air pressure difference, the one-way intake passages 3300 can be opened.

Figure 4:
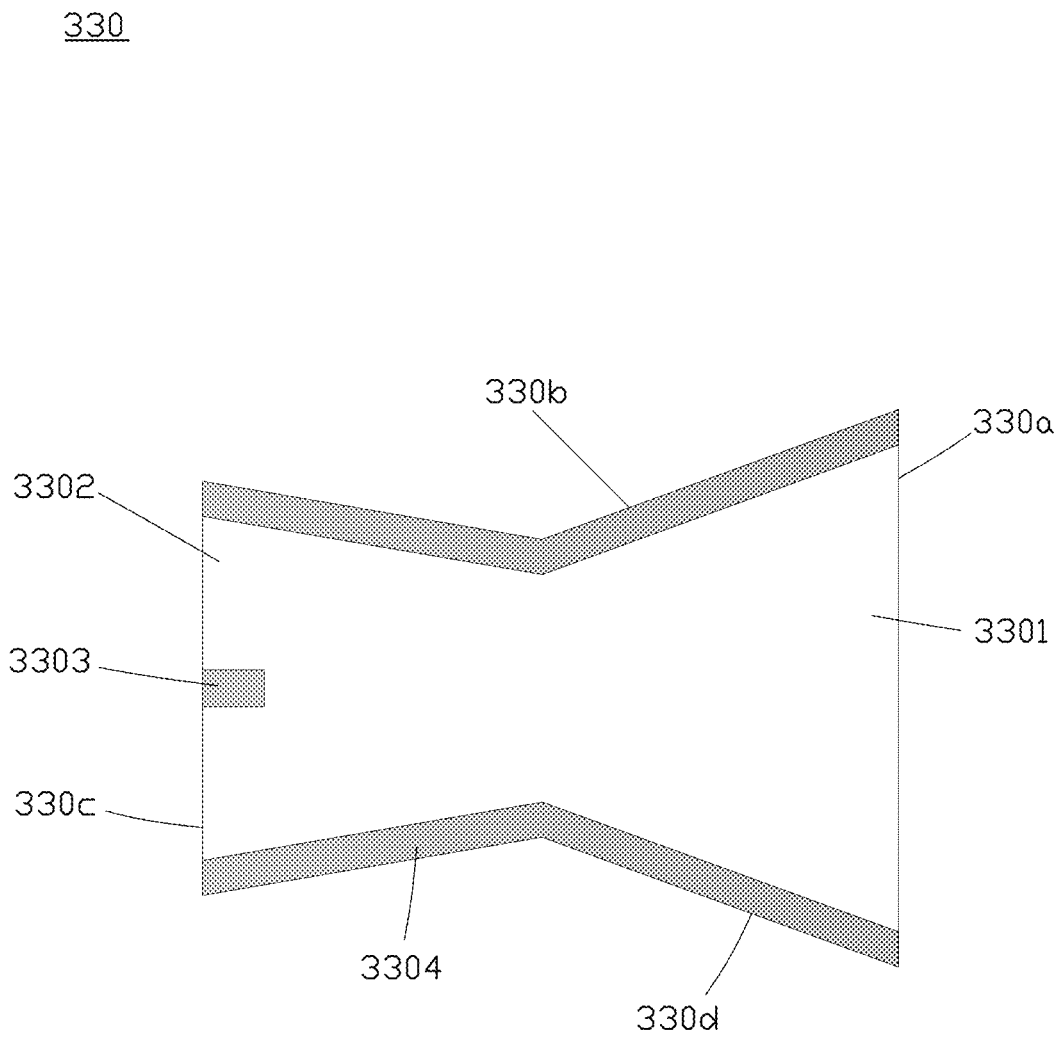
FIG. 4 is a schematic top view showing a one-way air inlet member used in the cushion airbag pad of the present disclosure.

As shown in FIG. 4, four side edges of the one-way air inlet member 330 are a first edge 330*a*, a second edge 330*b*, a third edge 330*c*, and a fourth edge 330*d* in sequence. The first edge 330*a* and the third edge 330*c* are opposite to each other and open (i. e. the first sheet 331 and the second sheet 332 may be separated here), and the second edge 330*b* and the fourth edge 330*d* are opposite to each other and close to form a closed portion 3304 (i. e. the first sheet 331 and the second sheet 332 cannot be separated at the closed portion 3304). The one-way intake passage 3300 is formed from the first edge 330*a* to the third edge 330*c*. The first edge 330*a* extends to the intake air passage 210 and overlaps the first laminated portion 10A and the first embossed portion 10C.

As shown in FIG. 3, in the one-way air inlet member 330, the intake portion 3301 is mounted on the side of the intake airbag 121 close to the inflation airbag 110 in an open state. For example, the first sheet 331 in the inlet portion 3301 is fixedly mounted on the first cushion layer 101, and the second sheet 332 is fixedly mounted on the second cushion layer 102. It can be understood that the inlet portion 3301 may also be in a closed state, as long as the first sheet 331 and the second sheet 332 can be separated under an air pressure difference, and the intake portion 3301 can be designed at will according to practical requirements. The inlet portion 3301 has a closed structure. Preferably, inner surfaces of the first sheet 331 and the second sheet 332 in the air intake portion 3301 are made not smooth or coated with a surface adsorption inhibitor such as an antistatic agent, a lubricant, or a separator. It will be appreciated that the first sheet 331 and the second sheet 332 at a portion of the inlet portion 3301 may also be fixedly mounted in the inlet air passage 210 and/or the air bag 110.

The outlet portion 3302 is sandwiched between the respective closed portion 3304 of the second edge 330*b* and the fourth edge 330*d* and away from the inlet air passage 210. The first sheet 331 and the second sheet 332 at the outlet portion 3302 are not pressed together, so that the outlet portion 3302 can be communicated across the air inlet direction D. In addition, a part of the outlet portion 3302 can also be closed by bonding, for example, a closure portion 3303 is provided in the outlet portion 3302, and the first sheet 331 and the second sheet 332 can be bonded together by means of welding, for example. The closure portion 3303 is, for example, formed on the third edge 330*c*. When the one-way air inlet member 330 is aged, the closing of the outlet portion 3302 can be assisted by means of the closure portion 3303, thereby preventing air leakage caused by the fact that the outlet portion 3302 cannot be completely closed due to aging, etc.

Additionally, the inflation unit 300 may also include an intake valve 310. The intake valve 310 is mounted in the inflation airbag 110. The intake valve 310 may be a one-way valve for allowing external air to enter unidirectionally, or may be a cover for communicating with or isolating the inside and the outside of the cushion body 10.

The inflation unit 300 may also include an elastomer 320. The elastomer 320 is mounted in the inflation airbag 110, and supports the inflation airbag 110 to bulge in a natural state. Since the intake valve 310 is a one-way valve or a cover opened to communicate the air inside and outside the cushion body 10, the air can enter and fill the inflation airbag 110. In addition, in a state in which the inflation airbag 110 is pressed, since the intake valve 310 is a one-way valve or a cover closed to isolate the air inside and outside the cushion body 10, preventing the air from leaking to the outside, and at this time, under the action of the air pressure difference, the one-way air inlet member 330 allows the air to enter the interior of the plurality of airbags 100 unidirectionally. The air from the outside in the inflation airbag 110 enters the intake airbag 110 via the intake air passage 210, then the inflation airbag 110 is released, and under the elastic reset action of the elastomer 320, the elastomer 320 supports the inflation airbag 110 to reset. At this time, under the action of the air pressure difference, the air is sucked into the inflation airbag 110, and meanwhile, the one-way air inlet member 330 prevents the air in the intake airbag 110 from being sucked into the inflation airbag 110. The cushion body 10 can be inflated by repeatedly pressing and releasing the airbag 110. It should be understood that the elastomer may be any one of sponge, plastic, spring, rubber, and silica gel, as long as it is an elastic component. Further, the elastomer 320 may be omitted, and air may be supplied into the inflation airbag 110 by an external inflator.

A deflation unit 400 is mounted in the deflation airbag 140 for allowing the air in the plurality of airbags 100 to be discharged to the outside. In the present embodiment, the deflation unit 400 may be a one-way valve for unidirectionally discharging internal air, or may be a cover for communicating with or isolating the inside and the outside of the cushion body 10, and the deflation unit 400 is deflated by pressing the cushion body or a suction pump outside.

Figure 8:
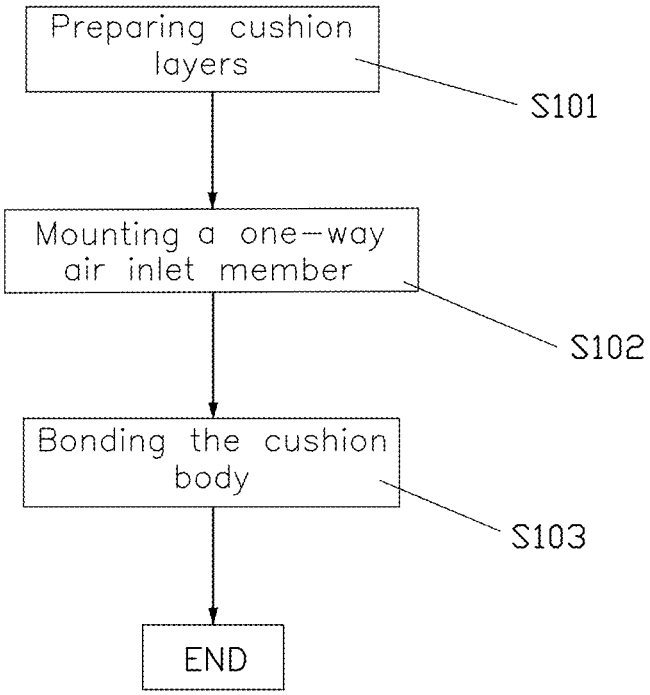
FIG. 8 is a flow chart showing an example of a method for producing the cushion airbag pad according to the present disclosure.
Figure 9:
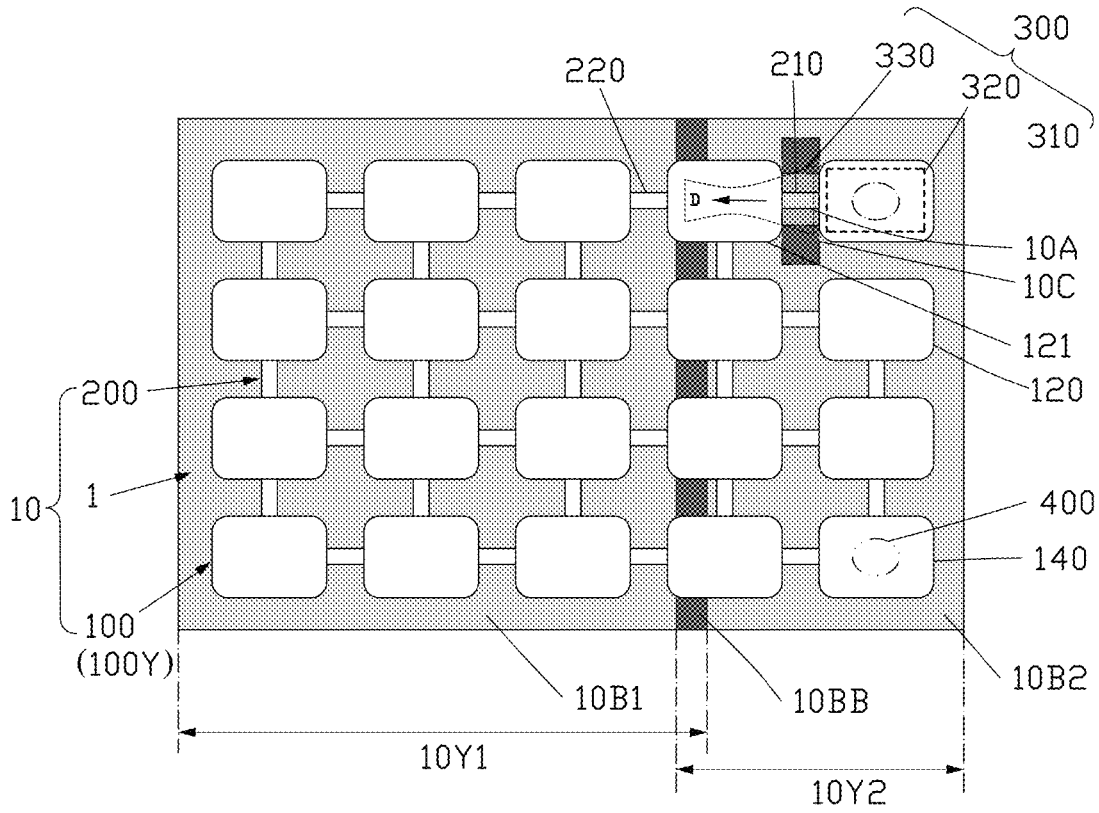
FIG. 9 is a schematic plan view showing another example of the cushion airbag pad of the present disclosure.

The cushion airbag pad 1000 of the present embodiment can be manufactured by the method shown in FIG. 8.

First, in a step S101, a first cushion layer 101 and a second cushion layer 102 are prepared. The first cushion layer defines a plurality of airbag areas 100Y, a cushion bonding area 10Y surrounding the airbag areas 100Y, and an inlet member bonding area 330Y where an air inlet end of a thin sheet type one-way air inlet member 330 is located, the inlet member bonding area 330Y overlapping with a part of the cushion bonding area 10Y.

Then, in step S102, the one-way air inlet member 330 fitted with a jig K in the intake portion 3301 is placed into the intake airbag 121. In this case, the jig K is sandwiched between the first sheet 331 and the second sheet 332, and the one-way air inlet member 330 is sandwiched between the first cushion layer 101 and the second cushion layer 102. In the state where the one-way air inlet member 330 is embedded in the intake airbag 121, the inlet member bonding area 330Y of the cushion body 10 in which a part of the intake portion 3301 of the one-way air inlet member 330 overlaps the main body 1, is pressed against. Thus, at the intake portion 3301, the first sheet 331 and the first cushion layer 101 are bonded together, and the second sheet 332 and the second cushion layer 102 are bonded together. The intake portion 3301 can be maintained in an open state by virtue of the bulging shape of the intake airbag 121 on the first cushion layer 101. The inlet member bonding area 330Y may or may not overlap the intake air passage 210. The bonding may be performed by a bonding device (not shown) comprising an upper mold and a lower mold facing each other in an up-down direction. The upper mold and the lower mold are pressed by sandwiching the first cushion layer 101 and the second cushion layer 102 close to each other, so that the main body 1 can be pressed. In this step, the area where the upper mold and the lower mold press against each other corresponds to the inlet member bonding area 330Y.

Then, in step S103, a cushion bonding area 10Y in the cushion body 1 is pressed against, to wherein the cushion bonding area overlaps the one-way air inlet member 330 and the inlet member bonding area 330Y The first embossed portion 10C is formed at a position where the cushion bonding area 10Y overlaps the inlet member bonding area 330Y A first laminated portion 10A is formed in the inlet member bonding area 330Y excluding the first embossed portion 10C, the second laminated portion 10B is formed in the cushion bonding area 10Y excluding the first embossed portion 10C, the first embossed portion 10C is interposed between the first laminated portion 10A and the second laminated portion 10B. In step S103, the bonding can be performed by using the bonding device. Different from the step S102, in the step S103, the area where the upper mold and the lower mold being pressed against each other corresponds to the cushion bonding area 10Y.

In addition, when the airbag 110 includes the elastomer 320, the elastomer 320 may be put into the airbag 110 in any step prior to step S103.

According to the described method, the cushioning airbag pad 1000 of the present disclosure can be manufactured, and according to the cushioning airbag pad 100 of the present disclosure, one-way air intake can be reliably performed inside the airbags 100.

Second Embodiment

Figure 6:
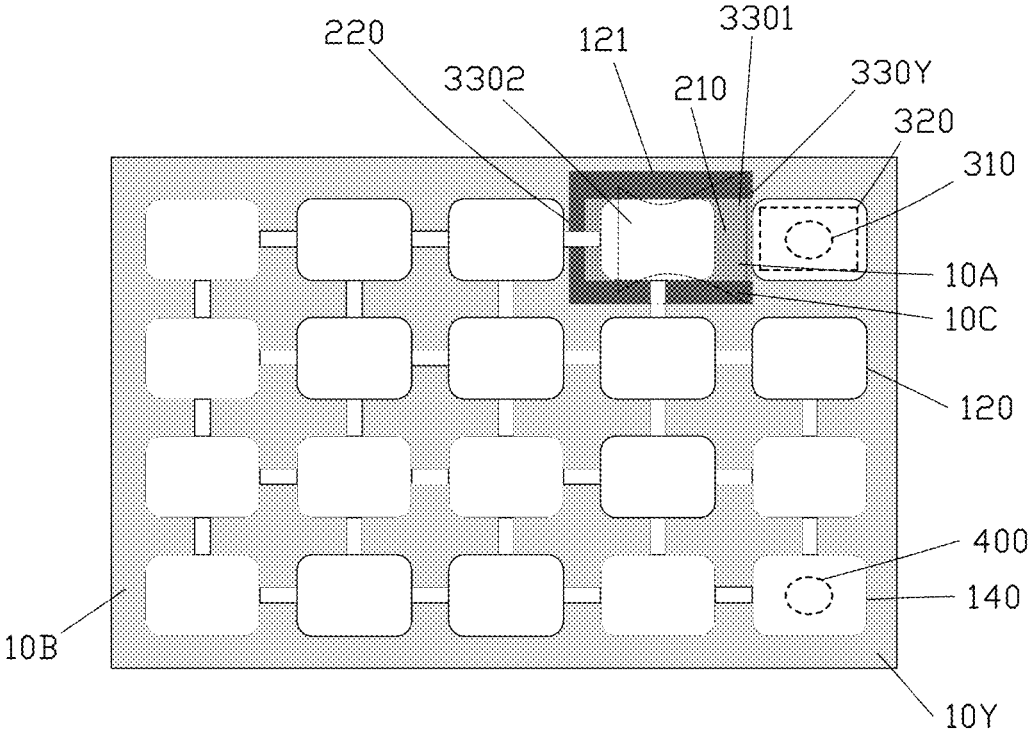
FIG. 6 is a schematic top view showing a manufacturing example of a cushion airbag pad of the present disclosure.

In the cushioning airbag pad 1000 of the present embodiment, as shown in FIG. 6, the one-way air inlet member 330 may be disposed in the intake airbag 121, and two side end edges 330*b* and 330*d* of the one-way air inlet member 330 may extend beyond the intake airbag 121 and overlap a part of the main body 1.

Figure 7:
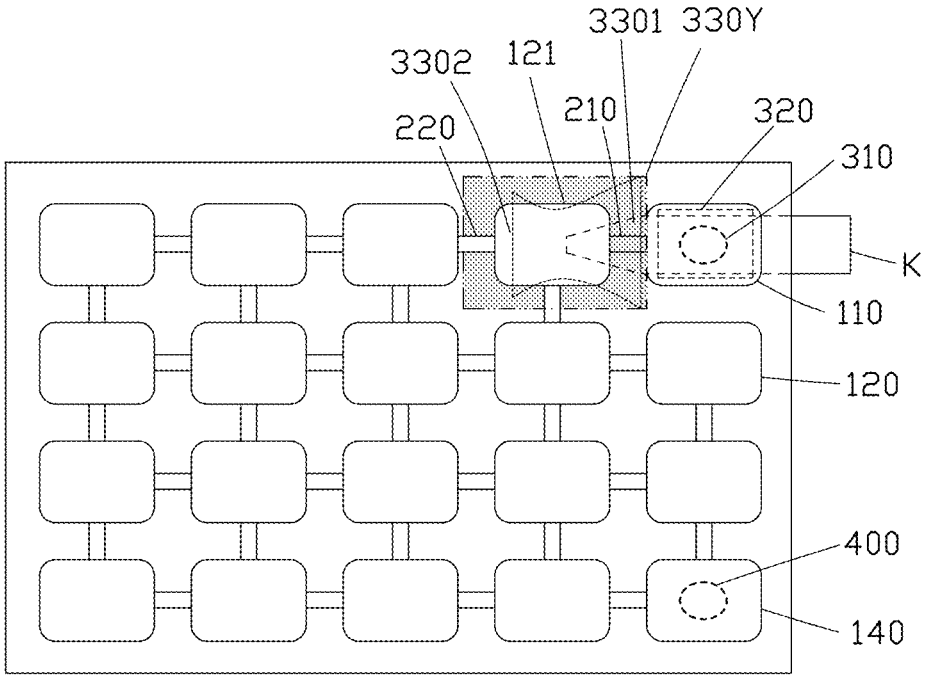
FIG. 7 is a schematic top view showing an example of a cushion airbag pad of the present disclosure.

The inlet member bonding area 330Y may surround the intake airbag 121 as shown in FIG. 7. Depending on the position where the cushion bonding area 10Y is bonded, the intake airbag 121 may be formed so as to be surrounded only by the first laminated portion 10A, or may be formed so as to be surrounded by the first laminated portion 10A and the first embossed portion 10C as shown in FIG. 6. Therefore, the two side edges 330*b* and 330*d* and the first edge 330*a* of the one-way air inlet member 330 also overlap the first laminated portion 10A, or overlap the first laminated portion 10A and the first embossed portion 10C.

In addition, the inlet member bonding area 330Y may or may not overlap the intake passage 210.

The cushion airbag pad 1000 of the present embodiment has the same configuration and manufacturing method as those of the first embodiment except for the above-described points.

Third Embodiment

In the cushioning airbag cushion 1000 of the present embodiment, the main body 1 further comprises a second embossed portion 10BB intersecting with or being vertical to the air inlet direction D of the one-way air inlet member 330. The second embossed portion 10BB extends to two opposite sides of the cushion airbag pad. And the second embossed portion 10BB and one-way air inlet member 330 are respectively connected to two sides of the intake airbag 121 in a clamping manner, and the second laminated portion 10B is divided into two portions of the first part 10B1 and the second part 10B2 by the second embossed portion 10BB.

The first part 10B1 and the second part 10B2 of the second laminated portion 10B are pressed together once in different steps, and the second embossed portion 10BB is pressed together twice.

Similarly to the embossed of the first embossed portion 10C, the second embossed portion 10B may be formed as patterns such as step shape, wrinkles or the like at the boundary, or may be formed to have a harder rigidity and a smoother surface.

The cushion airbag pad 1000 of the present embodiment has the same configuration as those of the first embodiment except for the above-described points.

Figure 10:
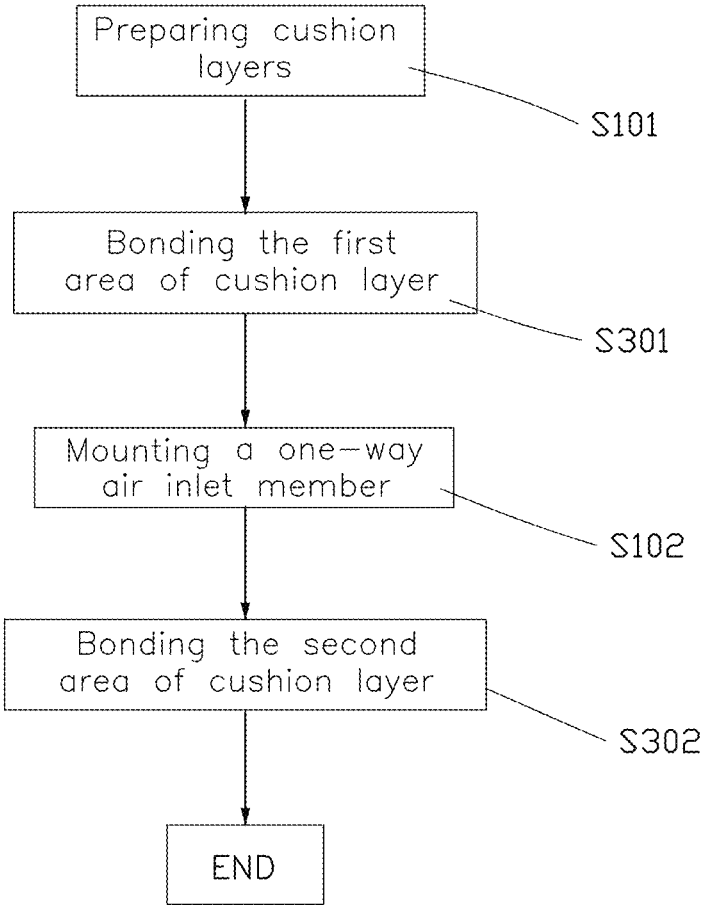
FIG. 10 is a flowchart illustrating another example of the manufacture method for the cushion airbag pad according to the present disclosure.

Hereinafter, a method for manufacturing the cushion airbag pad 1000 according to the present disclosure will be described with reference to FIG. 10.

First, in step S101, a first cushion layer 101 and a second cushion layer 102 are prepared.

Next, in step S301, the first cushion layer 101 and the second cushion layer 102 are placed overlapping between the upper mold and the lower mold of the bonding device, and the first cushion bonding area 10Y1 of the cushion body 10 is pressed.

Next, the same step S102 as described above is executed, and in step S102, the one-way air inlet member 330 is pressed inside the main body 1 by bonding the inlet member bonding area 330Y.

Next, in step S302, the second cushion bonding area 10Y2 of the cushion pad 10 is pressed. The first part 10B1, the second part 10B2, and the second embossed portion 10BB are thereby formed. The second embossed portion 10BB is formed in a portion where the second cushion bonding area 10Y2 overlaps the first cushion bonding area 10Y1, a second part 10B2 is formed in a portion of the second cushion bonding area 10Y2 that does not overlap the first cushion bonding area 10Y1, and a first part 10B1 is formed in a portion of the first cushion bonding area 10Y1 that does not overlap the second cushion bonding area 10Y2.

According to the described method, the cushioning airbag pad 1000 of the present disclosure can be manufactured, and according to the cushioning airbag pad 100 of the present disclosure, one-way air intake can be reliably performed inside the airbags 100.

It can be understood that, in this embodiment, step S103 used in the first embodiment and the second embodiment is split into two steps S301 and S302. Thus, compared with the first embodiment and the second embodiment, the one-way air intake 330, especially the outlet portion 3302, is heated only in step S302, and thus the one-way air inlet member 330 is not easily deformed by heat. Thus, according to the cushion airbag pad 1000 and the method for manufacturing the cushion airbag pad 1000 of the present embodiment, advantages of high yield, long service life and good inflation effect can also be obtained.

The foregoing description is merely a detailed embodiment of the present disclosure, but the scope of protection of the present disclosure is not limited thereto. Any people skilled in the art would be able to make equivalent replacements or changes within the technical scope disclosed by the present disclosure, and all should be covered within the scope of protection of the present disclosure.

What is claimed is:

1. A cushion airbag pad, comprising:

a cushion body comprising a main body, a plurality of airbags and a plurality of air passages, wherein two adjacent airbags of the plurality of airbags are in communication via a corresponding one of the plurality of air passages; one of the plurality of airbags is an intake airbag; and a one-way air inlet member being a thin sheet structure and mounted in the intake airbag, the one-way air inlet member configured to direct air flow into an interior of the plurality of airbags unidirectionally, wherein a first embossed portion is formed on the main body and is in contact with at least a part of the one-way air inlet member in an overlapping manner, and a hardness of a portion of the main body corresponding to the first embossed portion is greater than a hardness of a portion of the main body corresponding to the one-way air inlet member, and the portion of the main body corresponding to the one-way air inlet member does not overlap with the first embossed portion.

2. The cushion airbag pad according to claim 1, wherein the main body further comprises a first laminated portion directly connected to the first embossed portion and a second laminated portion formed at a region of the main body excluding the first laminated portion and the first embossing portion, the first laminated portion is in contact with at least a part of the one-way air inlet member in the overlapping manner, and the hardness of the portion of the main body corresponding to the first embossed portion is greater than a hardness of a portion of the main body corresponding to the first laminated portion.

3. The cushion airbag pad according to claim 2, wherein the intake airbag is surrounded by the first laminated portion and the first embossed portion, or the intake airbag is surrounded by the first laminated portion and the second laminated portion, or the intake airbag is surrounded by the first laminated portion, the second laminated portion, and the first embossed portion, or the intake airbag is surrounded only by the first laminated portion.

4. The cushion airbag pad according to claim 2, wherein the plurality of air passages comprise an intake passage and a plurality of ventilation passages, the intake passage is connected to an upstream side of the intake airbag, and the plurality of ventilation passages are connected to a downstream side of the intake airbag, the one-way air inlet member is mounted in the intake airbag along an air inlet direction and extends to the air intake passage on the upstream side of the intake airbag, one end of the one-way air inlet member is in communication with the intake passage, and another end of the one-way air inlet member, on an opposite side, is in communication with the intake airbag for directing air flow into the intake airbag unidirectionally from the intake passage, one part of the first laminated portion is connected to the intake passage, and another part of the first laminated portion is in contact with the intake passage in the overlapping manner; and the first embossed portion is connected to one side of the first laminated portion away from the intake passage.

5. The cushion airbag pad according to claim 4, wherein the cushion body is integrally formed by stacking a first cushion layer and a second cushion layer, a plurality of areas of the first cushion layer bulge towards a direction away from the second cushion layer to form the plurality of airbags, the thin sheet structure of the one-way air inlet member includes a first sheet and a second sheet which overlap with each other, a one-way intake passage is formed between the first sheet and the second sheet in the air inlet direction, the one-way intake passage directs air to flow into the intake airbag unidirectionally via the air intake passage, and the first sheet is mounted on the first cushion layer, and the second sheet is mounted on the second cushion layer.

6. The cushion airbag pad according to claim 5, wherein the first embossed portion is embossed on at least one of the first cushion layer and the second cushion layer.

7. The cushion airbag pad according to claim 5, wherein the one-way air inlet member includes an inlet portion and an outlet portion at two opposite sides along the air inlet direction, the inlet portion is maintained in an open state, the outlet portion is maintained closed and can be opened when an air pressure difference between the inlet portion and the outlet portion is greater than a preset value, and the inlet portion is in communication with the outlet portion via the one-way intake passage, the outlet portion partially overlaps with the first laminated portion and further partially overlaps with the first embossed portion, and the inlet portion is located inside the intake airbag.

8. The cushion airbag pad according to claim 7, wherein inner surfaces of the first sheet and the second sheet which are in contact with each other are smooth, a closure portion is provided at the edge of the one-way air inlet member where the outlet portion is provided, and the first sheet and the second sheet are pressed together at a position corresponding to the closure portion.

9. The cushion airbag pad according to claim 2, wherein the main body further comprises a second embossed portion, the second embossed portion intersects with the air inlet direction of the one-way air inlet member, and the second embossed portion and the one-way air inlet member are respectively connected to two sides of the intake airbag.

10. The cushion airbag pad according to claim 9, wherein the second embossed portion extends to two opposite sides of the cushion airbag pad, the second laminated portion is divided into two parts by the second embossed portion.

11. A cushion airbag pad, comprising a cushion body comprising a main body, a plurality of airbags and a plurality of air passages, wherein the cushion body is formed by stacking a first cushion layer and a second cushion layer, at least the first cushion layer bulges towards a direction away from the second cushion layer to form the plurality of airbags, two adjacent airbags of the plurality of airbags are in communication via a corresponding one of the plurality of air passages, one of the plurality of airbags is an intake airbag; and a one-way air inlet member, being a thin sheet structure and mounted in the intake airbag, the one-way air inlet member configured to direct air flow into an interior of the plurality of airbags unidirectionally;

wherein the plurality of airbags further comprises an inflation airbag configured for inflating the cushion airbag pad, through the one-way air inlet member, the air charged into the inflation airbag is unidirectionally introduced into the intake airbag, the one-way air inlet member is formed by a first sheet and a second sheet which overlap with each other, the first sheet is mounted on the first cushion layer, and the second sheet is mounted on the second cushion layer, the main body comprises:

a first laminated portion, disposed between the inflation airbag and the intake airbag, comprising the first cushion layer, the first sheet, the second sheet and the second cushion layer in sequence, and maintaining an open state in such a manner that the first sheet and the second sheet are separated at a side close to the intake airbag, and a first embossed portion, directly connected to the first laminated portion and at least a part of the first embossed portion is formed by a combination of the first cushion layer, the first sheet, the second sheet and the second cushion layer, and a hardness of a portion of the main body corresponding to the first embossed portion is greater than a A hardness of a portion of the main body corresponding to the first laminated portion.

12. The cushion airbag pad according to claim 11, wherein inner surfaces of the first sheet and the second sheet which are in contact with each other are smooth.

13. The cushion airbag pad according to claim 11, wherein the main body further comprises a second laminated portion formed at a region of the main body excluding the first laminated portion and the first embossing portion, the intake airbag is surrounded by the first laminated portion and the first embossed portion, or by the first laminated portion and the second laminated portion, or by the first laminated portion, the second laminated portion, and the first embossed portion, or only by the first laminated portion.

14. The cushion airbag pad according to claim 11, wherein an elastomer is mounted in the inflation airbag, and supports the inflation airbag to bulge.

15. The cushion airbag pad according to claim 14 wherein the inflation airbag is pressed, and the one-way air inlet member allows the air to enter the interior of the plurality of airbags unidirectionally, the air in the inflation airbag enters the intake airbag, then the inflation airbag is released, and under an elastic reset action of the elastomer, the elastomer supports the inflation airbag to reset, meanwhile, under the action of a air pressure difference, the air is sucked into the inflation airbag.

16. A manufacture method of cushion airbag pad, comprising:

preparing a first cushion layer and a second cushion layer, wherein the first cushion layer defines a plurality of airbag areas, a cushion bonding area surrounding the airbag areas, and an inlet member bonding area where an air inlet end of a thin sheet type one-way air inlet member is located, the inlet member bonding area overlapping with a part of the cushion bonding area;

providing the thin sheet type one-way air inlet member between the first cushion layer and the second cushion layer, and making the air inlet end of thin sheet type one-way air inlet member to be arranged at the inlet member bonding area;

pressing the first cushion layer, the second cushion layer and the one-way air inlet member corresponding to the inlet member bonding area;

pressing the first cushion layer and the second cushion layer corresponding to the cushion bonding area, thereby forming at least one embossed portion in an overlapping area of the inlet member bonding area and the part of the cushion bonding area, and a plurality of airbags in the airbag areas, wherein a hardness of the at least one embossed portion is greater than a hardness of portions of the inlet member bonding area excluding the at least one embossed portion.

17. According to the manufacture method of claim 16, wherein

In the step of pressing the inlet member bonding area, a first laminated portion is formed in the inlet member bonding area excluding the at least one embossed portion, in the step of pressing the cushion bonding area, a second laminated portion is formed in the cushion bonding area excluding the at least one embossed portion, the at least one embossed portion is interposed between the first laminated portion and the second laminated portion.

18. According to the manufacture method of claim 17, wherein the main body further comprises a second embossed portion, the second laminated portion is divided into two portions of a first part and a second part by the second embossed portion, the cushion bonding area includes a first cushion bonding area and a second cushion bonding area, the step of pressing the cushion bonding area comprises:

before the step of pressing the inlet member bonding area, pressing the first cushion bonding area in the main body; and after the step of pressing the inlet member bonding area, pressing the second cushion bonding area in the main body, the second embossed portion is formed in a portion where the second cushion bonding area overlaps the first cushion bonding area, the second part is formed in a portion of the second cushion bonding area that does not overlap the first cushion bonding area, and the first part is formed in a portion of the first cushion bonding area that does not overlap the second cushion bonding area.

19. According to the manufacture method of claim 18, wherein the second embossed portion is pressed twice to exhibit the embossing.

* * * * *